United States Patent [19]

Grunert et al.

[11] Patent Number: 4,639,564

[45] Date of Patent: Jan. 27, 1987

[54] CIRCUIT BREAKER WITH ARC CHAMBER VENT

[75] Inventors: Kurt A. Grunert, Beaver Boro; Roger E. Walker, Franklin Township, Beaver County; Charles R. Paton, New Brighton; David A. Leone, Center Township, Beaver County, all of Pa.

[73] Assignee: Westinghouse Electric Corp., Pittsburgh, Pa.

[21] Appl. No.: 729,437

[22] Filed: May 1, 1985

[51] Int. Cl.[4] ..... H01H 33/04

[52] U.S. Cl. ..... 200/144 R; 200/304; 200/305; 200/306

[58] Field of Search ..... 200/144 R, 147 R, 304, 200/305, 306

[56] References Cited

U.S. PATENT DOCUMENTS

| | | | |
|---|---|---|---|
| 2,225,791 | 12/1940 | Nau et al. | 200/306 |
| 2,727,965 | 12/1955 | Toth et al. | 200/304 |
| 3,171,936 | 3/1965 | Jencks et al. | 200/147 R |

*Primary Examiner*—Robert S. Macon
*Attorney, Agent, or Firm*—L. P. Johns

[57] ABSTRACT

A circuit breaker with arc chamber vent characterized by a molded insulating housing containing circuit breaker means and an arc quenching chamber, the housing having wall means forming a compartment containing a terminal, and the wall means having gas vent opening communicating between the chamber and the compartment and a tubular wall surrounding the terminal for preventing any arc gases exhausting from the chamber into the compartment from causing electrical breakdown between the terminal and any proximate conductor.

7 Claims, 7 Drawing Figures

FIG.6
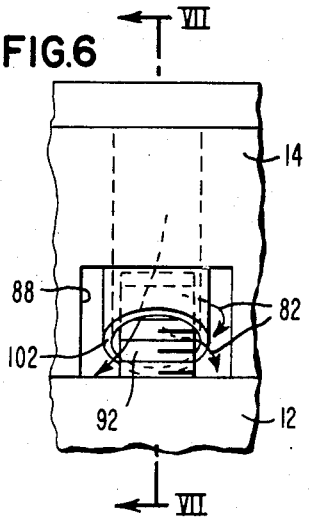
FIG.7
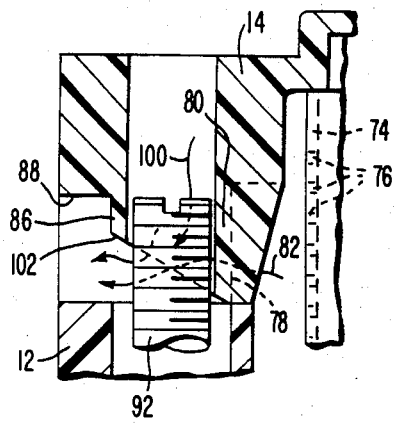
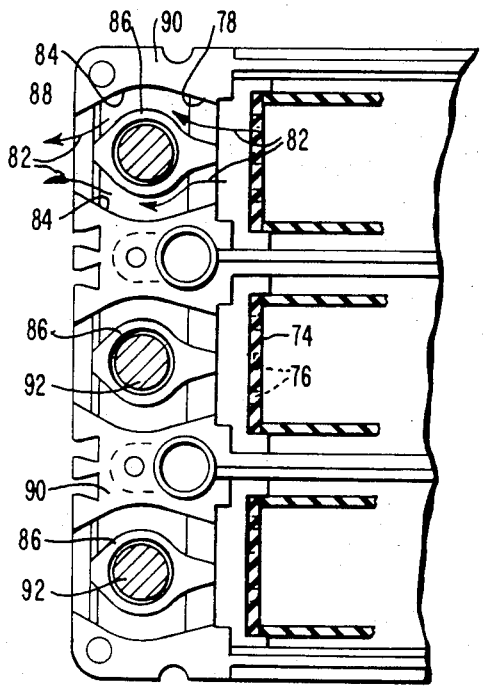
FIG.2

CIRCUIT BREAKER WITH ARC CHAMBER VENT

CROSS-REFERENCE TO RELATED APPLICATION

This application is related to copending application Ser. No. 716,305, filed Mar. 27, 1985, Circuit Breaker Apparatus With Line Terminal Shields, the invention of Mrenna and G. Vosler, assigned to the assignee of this application.

BACKGROUND OF THE INVENTION

1. Field of the Invention

This invention relates to a molded case circuit breaker, and more particularly, it pertains to a circuit breaker having a terminal shield for preventing electrical breakdown due to ionized gases exhausting from an arc chute chamber.

2. Description of the Prior Art

The control of exhausting gases from a circuit breaker during opening of the contacts has always been a problem. This is particularly true for circuit breakers of small physical size with high interrupting ratings. But where wiring terminals are used in close proximity to the circuit breaker vents, the problem is especially acute. When an arc occurs during opening of the contacts, ionized arc gases can cause a breakdown between the terminals of the circuit breaker and any metallic enclosure within which the circuit breaker is mounted. A breakdown of this type can develop into a ground fault and, if severe enough, create a phase-to-phase fault outside of the breaker.

SUMMARY OF THE INVENTION

In accordance with this invention, a circuit breaker with an arc chamber vent is provided which comprises an electrically insulating housing including a base and a detachable cover, the base having line and load terminals, an arc quenching chamber within the housing, a circuit breaker structure within the housing and having stationary and movable contacts operable between opened and closed positions in an arcing zone within the chamber, the contacts forming a circuit breaker path between the terminals, operating means for actuating the contacts, the housing having wall means forming a compartment for containing each terminal and having openings between corresponding chambers, the wall means also forming a tubular wall around the terminal for insulating the terminal from any arc gases venting from the chamber and through the compartment to ambient air, and the tubular wall and wall means forming the compartment being spaced from each other to effect venting of the gas through the compartment and isolated from the terminal.

The circuit breaker of this invention provides a venting arrangement which directs exhausting arc gases around wiring terminals to prevent flashover between the terminal and any proximate electrical conductor.

BRIEF DECRIPTION OF THE DRAWINGS

FIG. 2 is a horizontal sectional view taken on the line II—II of FIG. 1;

FIG. 6 is a fragmentary elevational view showing the outer vent; and

FIG. 7 is a vertical sectional view taken on the line VII—VII of FIG. 6.

DESCRIPTION OF THE PREFERRED EMBODIMENTS

Figure 1:
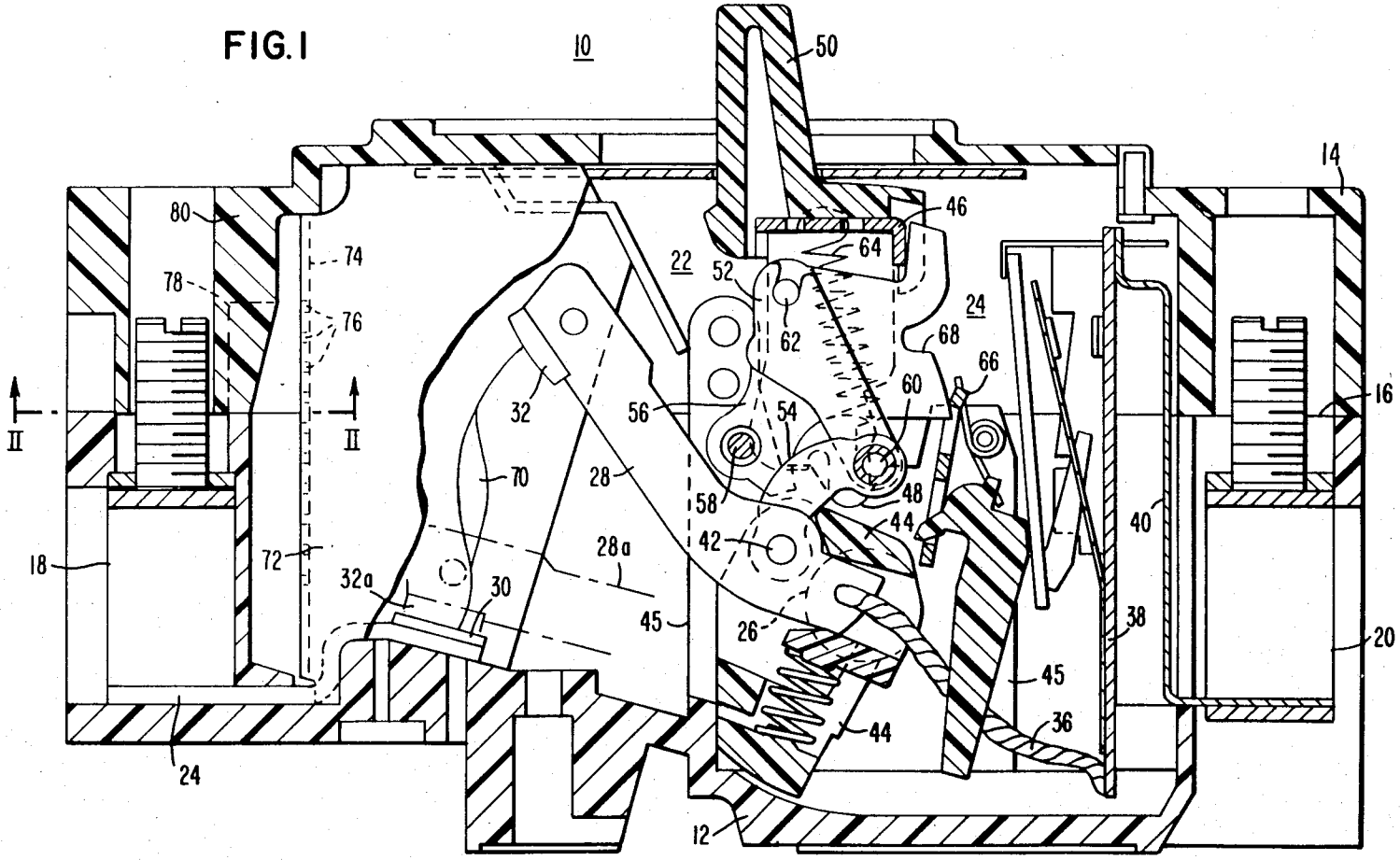
FIG. 1 is a vertical sectional view through a circuit breaker showing the arc chamber vent of this invention.

In FIG. 1 a molded case circuit breaker is generally indicated at 10 and includes a molded, electrically insulating housing or base 12 having a cover 14 which is mechanically attached at a parting line 16 where it is retained in place by a plurality of fasteners such as screws (not shown). A line terminal 18 is disposed at one end of the housing 12 and a load terminal 20 is disclosed at the other end. Although the circuit breaker 10 is disclosed as a single phase structure, it is particularly applicable to polyphase circuit interrupters such as a three phase or three pole circuit breaker. For a polyphase circuit breaker, a pair of similar terminals 18, 20 are provided for each phase. The terminals 18, 20 are employed to serially electrically connect the circuit breaker 10 into an electrical circuit such as a three phase circuit, to protect the electrical system involved.

The circuit breaker 10 comprises an operating mechanism 22, a trip device 24, a tie bar 26, a contact arm 28, and a pair of separable contacts including a fixed contact 30 and a movable contact 32.

Although the circuit breaker 10 (FIG. 1) is disclosed in the tripped position with the contacts 30, 32 separated, the closed position of the arm 28 is shown at 28*a* with the contacts 30, 32 in closed position. In that position a circuit through the circuit breaker extends from the terminal 18 through a conductor 24, the contacts 30, 32, the contact arm 28, a shunt 36, a thermal trip device 38, a conductor 40 to the terminal 20.

The contact arm 28 is pivotally connected at a pin 42 to a rotating carriage 44, which is secured to or integral with the insulating tie bar 26. The contact arm 28 and the carriage 44 accordingly rotate as a unit with the tie bar 26 during normal current conditions through the circuit breaker 10.

The single operating mechanism 22 is typically of that set forth in U.S. Pat. No. 4,503,408 for which reason the mechanism is not described herein in detail. Suffice it to say, the mechanism 22 is positioned in the center pole unit of a three pole circuit breaker and is supported between spaced plates (one of which plates 45 is shown) which are fixedly secured to the base 12 of the center pole unit. An inverted U-shaped operating lever 46 is pivotally supported on the plates 45 with the ends of the legs of the lever supported in U-shaped notches 48 of the plates.

In the U-shaped operating lever 46 is a handle 50 for manual operation of the mechanism 22. The mechanism 22 also comprises an overcenter toggle having an upper toggle link 52 and a lower toggle link 54 which connect the contact arm 28 to a releasable member or cradle 56 that is pivotally supported on the plates 45 by means of a pin 58. The toggle links 52, 54 are pivotally connected by means of a knee pivot pin 60. The toggle link 52 is pivotally connected at 62 to the cradle 56 and the link 54 is pivotally connected to the rotating carriage 44 at the pivot pin 42. Overcenter operating springs 64 are connected under tension between the knee pivot pin 60 and the bight portion of the lever 46.

Contacts 30, 32 are normally manually opened by movement of the handle 50 in a leftward direction to the position shown in FIG. 1 from the OFF to the ON position. However, inasmuch as a latch lever 66 of the trip device 24 is disengaged from a notch 68 in the cradle 56, the circuit breaker 10 is in the tripped position as shown in FIG. 1. For an explanation of resetting of the circuit breaker, reference is further made to U.S. Pat. No. 4,503,408.

For the purpose of this invention, the circuit breaker operating mechanism 22 may be tripped solely by a trip device 24 including the thermal trip device or bimetal 38. Other means for tripping, such as separate high speed electromagnetic trip devices, are described elsewhere such as in U.S. Pat. No. 4,220,935.

Figure 4:
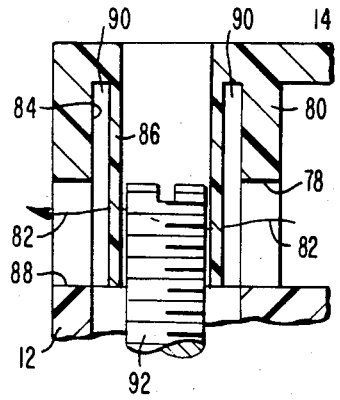
FIG. 4 is a fragmentary sectional view of the arc chamber vent.

In accordance with this invention, when the operating mechanism 22 is tripped, by whatever means such as the trip device 24, the contact arm 28 moves from the broken line position **28*a* to the open position (FIG. 1). As a consequence, an electric arc 70 is normally generated between the contacts 30, 32. As a result, ionized gases occur which require venting to the outside of the circuit breaker to minimize related problems that otherwise may occur. Normally an arc extinguishing device or arc chute 72 is disposed around the contact arm 28 to facilitate extinguishment of the arc in a well-known manner. For venting of the gases from the arc chute, a back wall 74 of the arc chute is provided with a plurality of vent holes 76 through which the gases pass under pressure (FIGS. 1, 2, 4) and through openings 78 in a wall 80 of the cover 14. From there the gases flow, as shown by arrows 82, through passages 84 around a tubular wall 86 from where they flow through an outlet 88 into the atmosphere. The passages 84 are disposed on opposite sides of the tubular wall 86 and cover wall portion 90 (FIGS. 2, 4**).

Figure 3:
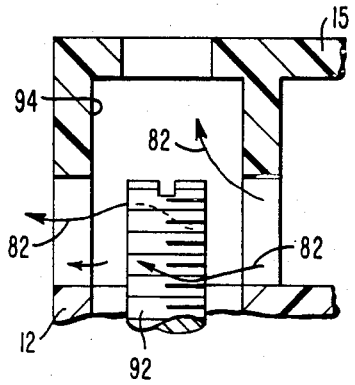
FIG.3 PRIOR ART
FIG. 3 is a fragmentary sectional view of a prior art structure.

The tubular wall 86 surrounds a clamp screw 92 to isolate it from the ionized gases indicated by the arrows 82. In this manner, the ionized arc gases are prevented from causing a breakdown between the terminal parts, such as the screw 92 and any steel enclosure within which the circuit breaker is mounted. A breakdown of this type can develop into a ground fault and, if severe enough, cause a phase-to-phase fault outside the breaker. For example, as shown in the prior art structure of FIG. 3, a cover 15 is mounted on the base 12 of the housing with the terminal screw 92 extending into a chamber 94 of the cover. It is noted that unlike the cover 14 (FIG. 4), the cover 15 includes no tubular wall so that the terminal screw 92 is completely exposed to gases flowing through the chamber 94 as indicated by the arrows 82. As a result, the prior art structure is conducive to breakdown due to exposure to the gases 82 through which breakdowns between the screw and nearby metal parts such as a steel enclosure external of the circuit breaker may occur.

Figure 5:
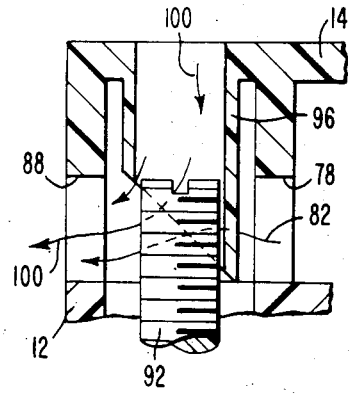
FIG. 5 is a fragmentary sectional view of another embodiment.

Other embodiments of the invention are shown in FIGS. 5, 6, and 7 in which similar numerals refer to similar parts. In FIG. 5 a tubular wall 96 extending from the top of the cover 14 has a biased end face 98 with the lower end of the face being disposed between the screw 92 and the openings 78. This construction not only protects the screw 92 from direct exposure to ionized gases as indicated by arrows 82, but also provides a cooling effect caused by siphoning or inflow of air indicated by arrows 100 from the top of the tubular wall 96 downwardly through the tube wall and around the screw 92 from where it exhausts into the atmosphere through the outlet 88. In a similar construction (FIGS. 6, 7), a biased end face 102 is disposed at the lower end of the tubular wall 86, whereby the siphon effect of the ionized gases 82 pass around the wall 80 and pass the lower end of the biased end face 102 to draw air 100 into the tube 80 to cool the screw 92 as the gases mix with the air to flow out of the circuit breaker via the outlet 88.

In conclusion, the construction of this invention consists of a tube, included as an extension below the internal surface of the cover, but external to the arc chamber vents. The outgassing that normally would tend, in part, to flow out of the cover holes, swirls around and past the tubes, thus venting axially to the line conductors. Thus, the tendency for outgassing to the enclosure is prevented. By utilizing an inverted taper or biased tube face at the internal tube end, the gas pressure tends to produce a siphon effect, causing cooling gas or air to be drawn into the tube and mixed with exhausting arc gas. The venting arrangement consists of two parallel channels molded in the cover of the circuit breaker which direct exhausting arc gases around the wiring terminals of the circuit breaker. Finally, the molded tubular structure enables access to terminal screws, but prevents gas expulsion through the cover holes, by directing ionized gases to flow through line vent paths, whereby the gas flow acts as a siphon for mixing fresh air with the hot gases for additional cooling.

What is claimed is:

1. A circuit breaker with arc chamber vent, comprising:

an electrically insulated housing including line and load terminals;

an arc quenching chamber within the housing;

a circuit breaker structure within the housing and having stationary and movable contacts operable between open and closed positions in an arcing zone within the chamber;

the contacts forming a circuit breaker path between the terminals;

operating means for actuating the contacts;

the housing having wall means forming a compartment for containing each terminal and having a first opening between each pair of corresponding chambers and compartments;

the wall means also forming second openings on the side of the chamber opposite the first openings, and the wall means also forming a tubular wall around the terminal and between the first and second openings for isolating the terminal from any arc gases venting from the chamber and through the compartment to ambient air, thereby avoiding an electrical breakdown between the terminal and any proximate electrical conductor.

2. The circuit breaker of claim 1 in which the tubular wall and the wall means forming the compartment are spaced from each other.

3. The circuit breaker of claim 2 in which the tubular wall is circular.

4. The circuit breaker of claim 2 in which the housing is a molded structure and the tubular wall is in integral portion thereof.

5. The circuit breaker of claim 1 in which the housing comprises a base and a detachable cover, and the compartment extending from the base and into the cover.

6. The circuit breaker of claim 5 in which the terminal is disposed within the compartment in the base and the cover including the tubular wall around a portion of the terminal extending above the base and into the cover compartment.

7. The circuit breaker of claim 6 in which the tubular wall includes an inverted tapered end facing away from the first opening.

* * * * *